US009003734B2

(12) United States Patent
Bott

(10) Patent No.: US 9,003,734 B2
(45) Date of Patent: Apr. 14, 2015

(54) MULTI-COMPONENT RETAINING WALL BLOCK WITH NATURAL STONE APPEARANCE

(75) Inventor: Timothy A. Bott, Sunfish Lake, MN (US)

(73) Assignee: Allan Block, LLC, Edina, MN (US)

( * ) Notice: Subject to any disclaimer, the term of this patent is extended or adjusted under 35 U.S.C. 154(b) by 0 days.

(21) Appl. No.: 13/241,703

(22) Filed: Sep. 23, 2011

(65) Prior Publication Data

US 2013/0074436 A1 Mar. 28, 2013

(51) Int. Cl.
*E02D 29/02* (2006.01)

(52) U.S. Cl.
CPC ..... *E02D 29/025* (2013.01)

(58) Field of Classification Search
CPC ..... E02D 29/02; E02D 29/025; E04B 1/02
USPC ..... 52/391, 476, 477, 511, 483, 314, 604, 52/606, 608, 609, 574, 311.1, 311.2, 316, 52/568; 405/262, 248, 286; D25/113
See application file for complete search history.

(56) References Cited

U.S. PATENT DOCUMENTS

| | | | | |
|---|---|---|---|---|
| 815,547 | A * | 3/1906 | Messmore | 52/316 |
| 1,329,893 | A | 2/1919 | Flynn | |
| 1,405,995 | A | 2/1922 | Flynn | |
| 3,379,017 | A * | 4/1968 | Kusatake | 405/31 |
| 3,464,211 | A | 9/1969 | Andersen | |
| 4,597,236 | A | 7/1986 | Braxton | |
| 4,802,320 | A | 2/1989 | Forsberg | |
| 4,815,897 | A | 3/1989 | Risi et al. | |
| 4,889,310 | A | 12/1989 | Boeshart | |
| 4,896,999 | A | 1/1990 | Ruckstuhl | |
| 4,909,010 | A | 3/1990 | Gravier | |
| 5,161,918 | A | 11/1992 | Hodel | |

(Continued)

FOREIGN PATENT DOCUMENTS

| | | |
|---|---|---|
| EP | 0112213 A1 | 6/1984 |
| FR | 1012498 A | 7/1952 |

(Continued)

OTHER PUBLICATIONS

Brochure, "The next generation segmental retaining wall system . . . Gravity Stone", Westblock Products, Inc., patent pending 1992, 3 pages.

(Continued)

*Primary Examiner* — Brian Glessner
*Assistant Examiner* — Adam Barlow
(74) *Attorney, Agent, or Firm* — Fredrikson & Byron, P.A.

(57) ABSTRACT

A mortarless retaining wall constructed of a plurality of segmental retaining wall (SRW) blocks stacked in an array of superimposed rows. Each SRW block includes a face unit having connectors and one or more anchoring units each having connectors. The anchoring unit connectors are of complementary shape to interlock with respective face unit connectors. The face unit and each anchoring unit forming the SRW block when interlocked, each anchoring unit for confronting soil being retained by the retaining wall. The face units have first and second load bearing surfaces and first and second end surfaces forming front edges which are non-linear along the entire edge. The first and second load bearing surfaces are non-planar across the entire load bearing surfaces.

20 Claims, 10 Drawing Sheets

(56) References Cited

U.S. PATENT DOCUMENTS

| | | | | | |
|---|---|---|---|---|---|
| 5,315,802 | A | | 5/1994 | Hart | |
| 5,337,527 | A | * | 8/1994 | Wagenaar | 52/169.2 |
| 5,350,256 | A | | 9/1994 | Hammer | |
| 5,474,405 | A | | 12/1995 | Anderson et al. | |
| 5,484,236 | A | | 1/1996 | Gravier | |
| 5,623,797 | A | | 4/1997 | Gravier et al. | |
| 5,688,078 | A | * | 11/1997 | Hammer | 405/286 |
| 5,707,184 | A | | 1/1998 | Anderson et al. | |
| 5,787,666 | A | * | 8/1998 | Sherry | 52/315 |
| 5,788,423 | A | * | 8/1998 | Perkins | 405/284 |
| 5,820,304 | A | | 10/1998 | Sorheim et al. | |
| 5,878,545 | A | | 3/1999 | Gebhart | |
| 6,062,772 | A | | 5/2000 | Perkins | |
| 6,082,067 | A | | 7/2000 | Bott | |
| 6,082,933 | A | | 7/2000 | Maguire et al. | |
| 6,189,282 | B1 | | 2/2001 | VanderWerf | |
| D459,487 | S | | 6/2002 | Bott | |
| 6,523,317 | B1 | | 2/2003 | Bott et al. | |
| 6,745,537 | B1 | | 6/2004 | Hamilton | |
| 6,854,236 | B2 | | 2/2005 | Bott | |
| 6,948,282 | B2 | | 9/2005 | Bott | |
| 7,198,435 | B2 | | 4/2007 | Dolan et al. | |
| 7,207,146 | B1 | * | 4/2007 | Morrell | 52/561 |
| 7,410,328 | B2 | * | 8/2008 | Hamel | 405/286 |
| 7,775,747 | B2 | * | 8/2010 | Bott | 405/286 |
| 7,963,727 | B1 | | 6/2011 | Wauhop | |
| 7,993,718 | B2 | * | 8/2011 | Riccobene | 428/44 |
| D667,141 | S | | 9/2012 | Bott | |
| 2001/0029717 | A1 | | 10/2001 | Spakousky | |
| 2004/0161307 | A1 | | 8/2004 | Hammer | |
| 2005/0254906 | A1 | | 11/2005 | Dolan et al. | |
| 2007/0196184 | A1 | | 8/2007 | Hammer et al. | |
| 2007/0292216 | A1 | | 12/2007 | Hamel | |
| 2010/0018146 | A1 | | 1/2010 | Aube et al. | |

FOREIGN PATENT DOCUMENTS

| | | | | |
|---|---|---|---|---|
| FR | 2536777 | A1 | | 6/1984 | |
| FR | 2542783 | A2 | | 9/1984 | |
| JP | 2000230240 | | | 8/2000 | |
| WO | 8808063 | | | 10/1988 | |
| WO | WO 8808063 | A1 | * | 10/1988 | E04C 1/40 |

OTHER PUBLICATIONS

PCT/US2012/056058, International Search Report and Written Opinion, dated Jul. 3, 2013, 9 pages.

* cited by examiner

Figure 1
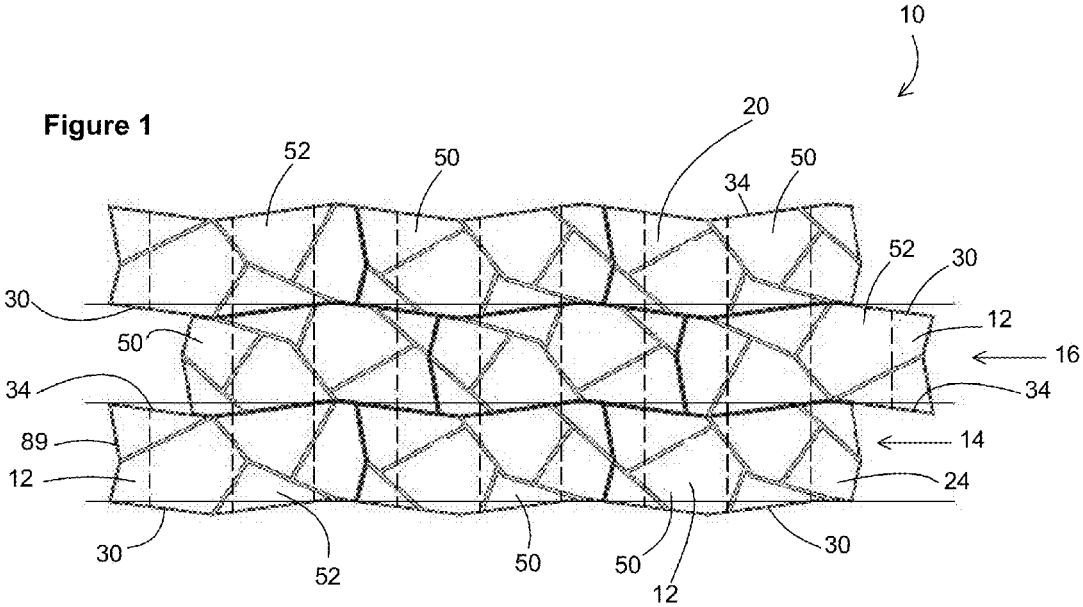
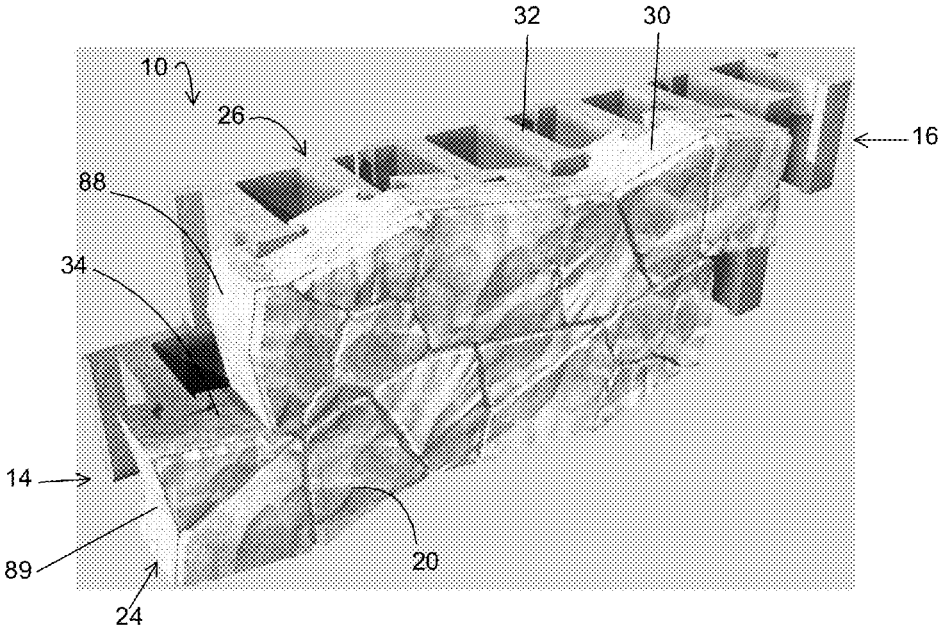
Figure 2

MULTI-COMPONENT RETAINING WALL BLOCK WITH NATURAL STONE APPEARANCE

TECHNICAL FIELD

The present disclosure pertains to segmental retaining wall block, and more particularly to a multi-component segmental retaining wall block with a natural stone appearance.

BACKGROUND

Retaining walls are commonly employed to retain highly positioned soil, such as soil forming a hill, to provide a usable level surface therebelow such as for playgrounds and yards, or to provide artificial contouring of the landscape which is aesthetically pleasant. Such walls have been made of concrete blocks having various configurations, the blocks generally being stacked one atop another against an earthen embankment with the wall formed by the blocks extending vertically or being formed with a setback. Setback is generally considered to be the distance in which one course of a wall extends beyond the front of the next highest course of the same wall. Concrete blocks have been used to create a wide variety of mortared and mortarless walls. Such blocks are often produced with a generally flat rectangular surface for placement onto the ground or other bearing foundation and for placement onto lower blocks in erecting the wall. Such blocks are also often further characterized by a frontal flat or decoratable surface and a flat planar top for receiving and bearing the next course of blocks forming the wall.

It is generally desired that retaining walls of the type described exhibit certain favorable characteristics, among which may be mentioned the ease with which the retaining wall can be assembled, the stability of the wall (that is, its ability to maintain structural integrity for long periods of time), and the ability of the wall to admit and disburse rainwater. Although retaining wall blocks commonly are supported vertically by resting upon each other, it is important that the blocks be restrained from moving outwardly from the earthen wall that they support.

Retaining wall blocks are an efficient material to use in constructing retaining walls, because they can easily be stacked side by side in sequential courses. While the faces of the blocks may have visually pleasing patterns, the edges of the blocks are nevertheless visible, particularly the continuous horizontal lines where the courses abut each other. As a result, even when the blocks have a patterned face, it is still apparent that the wall was constructed from blocks rather than natural stone. While the appearance of a natural stone wall is visibly appealing to some individuals, the construction of walls using natural stones is extremely labor intensive and expensive. It is therefore desirable to develop a retaining wall block having the advantage of ease of construction, stability, and lower cost, that more closely resembles a natural stone wall.

SUMMARY OF THE INVENTION

Embodiments of the present disclosure pertain to a segmental retaining wall (SRW) block, and more particularly to a multi-component SRW block that forms a mortarless retaining wall. In certain embodiments, the mortarless wall is constructed of a plurality of multi-component SRWs stacked in an array of superimposed rows. Each SRW block includes a face unit and one or more anchoring units for confronting soil retained by the retaining wall. The face unit has a facing surface defining part of the exposed surface of the retaining wall, and connectors. The anchoring units have connectors of complementary shape to interlock with respective face unit connectors such that the face unit and each anchoring unit form the SRW block when interlocked. The face unit has first and second load bearing surfaces and first and second end surfaces. The first load bearing surfaces are shaped to mate with the first or second load bearing surface of a superimposed stacked SRW block and to resist shear forces between surrounding SRW blocks which are generated by soil retained by the retaining wall against the SRW blocks. The anchoring units have upper and lower load bearing surfaces of the anchoring unit which are oriented in parallel and are generally planar across the entire load bearing surfaces. The first and second load bearing surfaces of the face unit are non-planar across the entire load bearing surfaces. In addition, the first and second load bearing surfaces and first and second end surfaces form front edges, with each front edge being non-linear along the entire edge. Each load bearing surface of the face unit may be shaped to mate along only part of a load bearing surface of a super-imposed, inverted, stacked face unit when such face units are laterally offset from each other in a staggered configuration. In some embodiments, the first load bearing surface is shaped to mate with the first load bearing surface of a super-imposed stacked SRW block. In some embodiments, the second load bearing surface is shaped to mate with the second load bearing surface of a super-imposed stacked SRW block. In some embodiments, the first end surface of each face unit is shaped to mate with the second end surface of an adjacent face unit.

In some embodiments, the face units in a lower row of face units are shaped identically to an upper row of face units stacked thereon, with the first load bearing surfaces on the lower row being shaped to mate along only part of the first load bearing surface on the upper row when the upper row face units are inverted and laterally offset from corresponding face units in the lower row in a staggered configuration.

In some embodiments, the upper load bearing surface of each anchor is shaped differently from the first load bearing surface of the face unit.

In some embodiments, the anchoring unit has at least one alignment element that aligns and resists the shear forces between a superimposed SRW block relative to its immediately subjacent block. The alignment element may be a lip, notch, pin recess, protrusion, or slot, for example. In some embodiments, the alignment element includes a lip of the anchoring units, the lip extending laterally under the anchoring units and at the rear thereof and resisting shear forces applied by the soil retained by the retaining wall against the SRW block. In some such embodiments, the anchoring units include a notch extending laterally over the anchoring units and at the rear thereof. In some such embodiments, the notch has a height which is generally less than or equal to a height of the lip. In some embodiments, the laterally extending lip is defined with a depth approximately equal to a depth of the notch such that a vertically extending wall can be formed using such SRW blocks. The laterally extending lip may be defined with a depth greater than the depth of the notch such that the retaining wall formed using such SRW blocks is formed with a setback, whereby the setback depth of each course of blocks is based on the difference in depths between the laterally extending lip and the notch. In some embodiments, the alignment element is a lip of the anchoring units which extends laterally over the anchoring units and at the rear thereof and resists shear forces applied by the soil retained by the retaining wall against the SRW block. In some embodiments, the anchoring units include a notch extending laterally under the anchoring units and at the rear thereof.

In some embodiments, the front surfaces having a pattern that includes grooves, all grooves being non-parallel to the upper and lower surfaces of the anchoring units. In some embodiments, the first and second load bearing surfaces of the face unit are parallel.

Other embodiments include mortarless retaining walls constructed of a plurality of segmental retaining wall (SRW) blocks stacked in an array of superimposed rows. Each SRW block includes a face unit having a facing surface defining at least part of the exposed surface of the retaining wall, and connectors, and one or more anchoring units each having two connectors. Each anchoring unit is of a complementary shape to interlock with respective face unit connectors, and confronts soil being retained by the retaining wall. The face unit and each anchoring unit, when interlocked, form the SRW block and at least one hollow core bounded by inner walls of the face unit and the anchoring unit. The face unit has first and second load bearing surfaces, the first load bearing surfaces shaped to mate with the first or second load bearing surfaces of a super-imposed stacked SRW block and resisting shear forces between surrounding SRW blocks, the shear forces generated by the soil retained by the retaining wall against the SRW blocks. The anchoring units have upper and lower load bearing surfaces oriented in parallel and generally planar across the entire load bearing surfaces. The load bearing surfaces of the face unit are generally non-planar across the entire load bearing surfaces. The first and second load bearing surfaces form front edges, each front edge being non-linear along the entire edge.

Still other embodiments include mortarless retaining walls constructed of a plurality of segmental retaining wall (SRW) blocks stacked in an array of superimposed rows. Each SRW block includes a face unit having a facing surface defining at least part of the exposed surface of the retaining wall and connectors, and one or more anchoring units having connectors. The anchoring unit connectors are of complementary shape to interlock with respective face unit connectors, forming the SRW block when interlocked with each anchoring unit for confronting soil retained by the retaining wall. The face unit has first and second load bearing surfaces, the first load bearing surfaces shaped to mate with the first or second load bearing surfaces of a super-imposed stacked SRW block and resisting shear forces between surrounding SRW blocks, the shear forces generated by the soil being retained by the retaining wall against the SRW blocks. The anchoring unit has upper and lower load bearing surfaces oriented in parallel and each being generally planar across the entire load bearing surfaces. The first and second load bearing surfaces of the face unit are non-planar across the entire load bearing surfaces and form first and second front edges which are non-linear along the entire front edge. Each anchoring unit has at least one alignment element that aligns and resists the shear forces between a superimposed SRW block relative to its immediately subjacent block. The alignment element may be a lip, notch, pin recess, protrusion, or slot.

BRIEF DESCRIPTION OF THE DRAWINGS

The following drawings are illustrative of particular embodiments of the invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

FIG. 1 is a front view of a retaining wall according to embodiments of the invention;

FIG. 2 is a perspective view of a portion of the retaining wall of FIG. 1;

DETAILED DESCRIPTION

Figure 3:
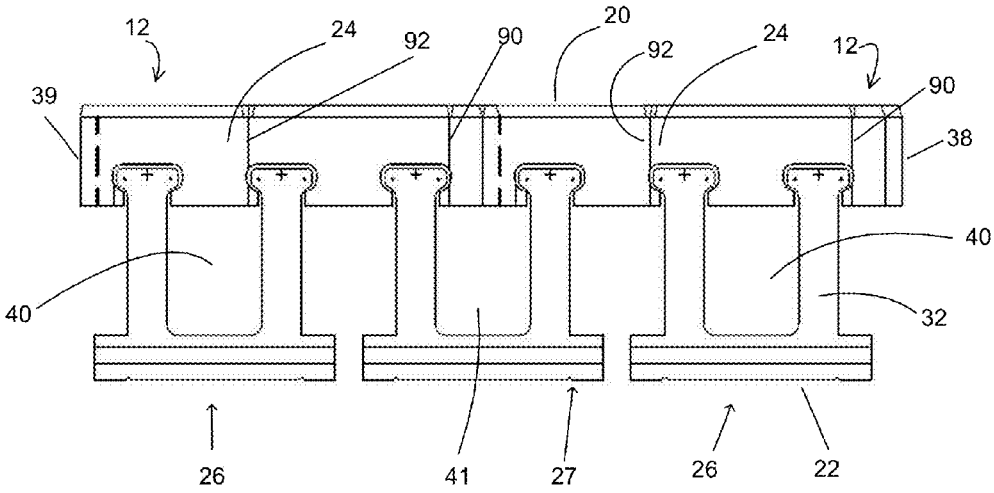
FIG. 3 is a top view of two of the segmental retaining wall units of FIG. 1.

The following detailed description is exemplary in nature and is not intended to limit the scope, applicability, or configuration of the invention in any way. Rather, the following description provides practical illustrations for implementing exemplary embodiments of the invention.

Mortarless retaining walls according to embodiments of the invention are constructed of a plurality of multi-component segmental retaining wall (SRW) blocks. As illustrated in FIGS. 1 and 2, the walls 10 consists of a first course 14 of SRW blocks 12 and a second course 16 of SRW blocks 12 stacked over the first course 14. Any number of courses is within the scope of the present invention. The embodiment shown does not include a set back. However, in alternative embodiments, the second course 16 may be constructed with a setback relative to the first course 14. Any level of setback, including no setback, is within the scope of the present invention. In addition, the second course 16 could even be set forward relative to the first course 14, either for the entire course or just intermittently within the second course. The front surface 20 of blocks 12 on the wall 10 are typically exposed. The back sides of blocks 12 on the wall 10, however, are typically hidden from view and confronting soil (not shown) being retained in place by the wall 10. The soil, of course, creates pressure on the back side of the wall 10 and its SRW blocks 12, tending to push the SRW blocks 12 forward.

FIG. 3 is a top view of two multi-component SRW block 12 according to some embodiments of the present invention. As shown, each SRW block 12 is comprised of two components, a face unit 24 and an anchoring unit 26, interlocked together via respective connector elements. In the embodiment shown, an additional connecting anchoring unit 27, identical to anchoring units 26, interconnects the SRW blocks 12. Each face unit 24 has a front surface 20 that defines part of the exposed surface of the retaining wall. Each face unit 24 also has three connector elements as described further below. Each anchoring unit 26 has a rear surface 22 against which soil bears and is retained. The anchoring unit 26 also has two connector elements of complementary size and shape to respective connector elements of the face unit. Several advantages are realized by forming SRW block 12 of two interlockable components. For instance, for those persons who move, stack, or otherwise handle SRW blocks from production to ultimate placement and wall assembly, it is much easier to lift, move, and accurately place a SRW block component than it is to lift, move, and accurately place an entire one-piece SRW block. Other advantages of the multi-component design are provided below.

The SRW blocks 12 in FIGS. 1 and 2 are freestanding. That is, no mortar is required to form the wall. The SRW block 12 has load bearing surfaces on the top and bottom of the block. The upper load bearing surface of the face unit 24 is formed by the first surface 30 or the second surface 34, depending upon its orientation, and the upper surface 32 of the anchoring unit 26. The lower load bearing surface of the face unit 24 is formed by the other of first surface 30 or the second surface 34, depending upon its orientation, and the anchoring unit lower surface 36.

Figure 4:
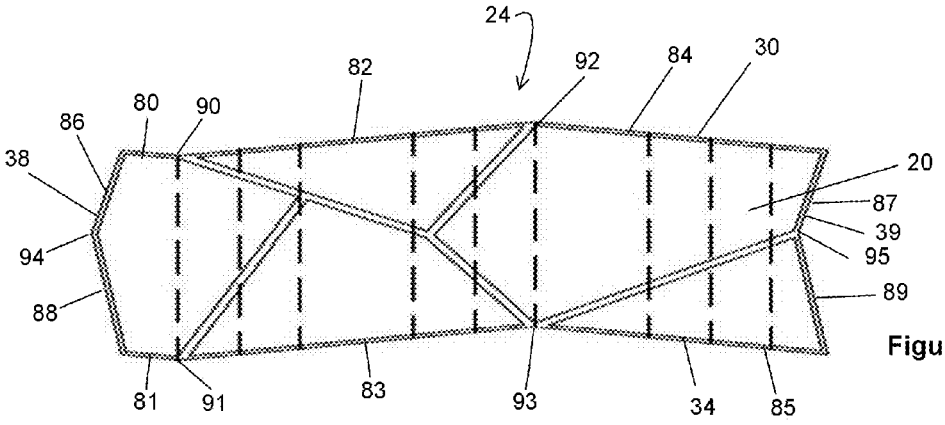
FIG. 4 is a front view of a face unit of FIG. 1.
Figure 5:
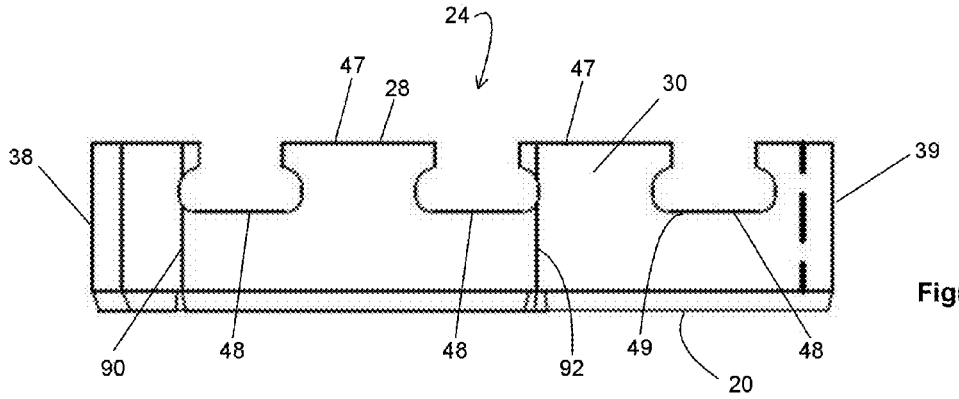
FIG. 5 is a top view of a face unit of FIG. 1.
Figure 6:
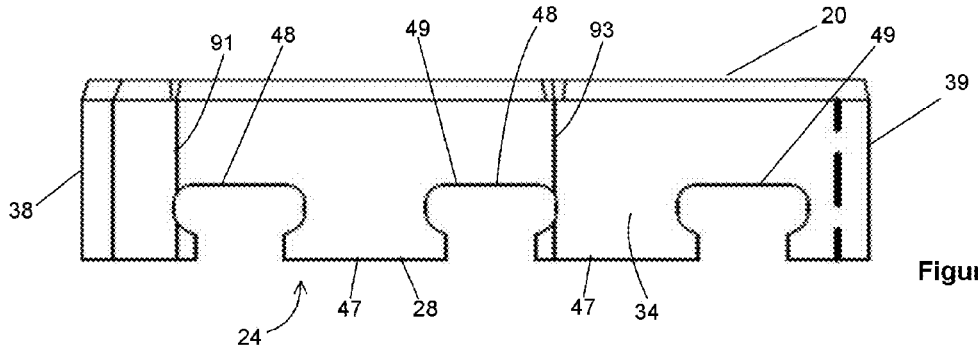
FIG. 6 is a bottom view of a face unit of FIG. 1.

FIG. 4 is a front view of the face unit of FIGS. 1-3, and FIGS. 5 and 6 are top and bottom views respectively. The opposing first surface 30 and second surface 34 of the face unit 24 extend along the length of the unit and are generally orthogonal to the front surface 20, but they are non-planar across the entire first surface 30 and second surface 34. That is, in this embodiment, both the first surface 30 and the second surface 34 include more than one plane. The first surface 30 has a first plane 80, a second plane 82, and a third plane 84. Likewise the second surface 34 has a first plane 81, a second plane 83, and a third plane 85. The first surface 30 has a first angle 90 between the first and second planes 80 and 82, and a second angle 92 between the second plane 82 and the third plane 84. The second surface 34 likewise has a first angle 91 between the first and second planes 81 and 83, and a second angle 93 between the second and third planes 83 and 85. Angles 90, 91, 92 and 93 are perpendicular to front surface 20 and extend from the front surface 20 to the back surface 28 of the face units 24. In this example, the first planes 80, 81 are parallel to each other, the second planes 82, 83 are parallel to each other, and the third planes 84, 85 are parallel to each other. In other embodiments either or both of the first 30 and second surface 34 may have more or less than three planes, and the planes may or may not be parallel to each other on opposing sides of the face unit 24.

As can best be seen in FIG. 2, when the blocks 12 are assembled into a wall 10, none of the planes of the first 30 and second 34 surfaces is horizontally oriented. In contrast, the upper surface 32 and lower surface 36 of the anchoring units 26 generally have a single plane extending across each surface (except for any notches or grooves, if present) and, when assembled into a wall, these surfaces are generally horizontally oriented. By eliminating the horizontal line typically visible between adjoining rows on the face of retaining walls, the non-horizontal nature of the first 30 and second 34 surfaces of the face units 24 makes the linear stacking of the blocks 12 less apparent and more irregular, appearing more like a natural stone wall. The presence of grooves which appear like mortar lines on the front face 20 further contributes to the natural, field stone like appearance of the wall 10. These grooves, in combination with the meandering joinder line where upper and lower rows abut and which appear similar to the grooves, disrupts the visual perception of rows and suggests the presence of irregularly shaped natural stones.

It can further be seen that the first and second end surface 38, 39 while perpendicular to the front surface 20, are also non-planar across their surfaces. Rather each end surface 38, 39 has more than one plane. In the example shown, the first end surface 38 has a first plane 86 and a second plane 88 separated by angle 94, and the second end surface 39 has a first plane 87 and a second plane 89 separated by angle 95. The first planes 86, 87 and second planes 88, 89 are parallel to each other and perpendicular to front surface 20 and angles 94 and 95 extend from the back 28 to the front 20 surface. In other embodiments, one or both of the end surfaces 38, 39 may have more or less than two planes which may or may not be parallel to the surface of the opposing end directly opposite it. When stacked into a wall 10, none of the planes of the end surfaces 38, 39 are vertically oriented. The non-planar and non-vertical nature of these surfaces further adds to obscuring the visual appearance of the blocks 12 as blocks in rows and adds to the field stone like appearance of the wall. As such, while each of the first and second surfaces 30, 34 of face unit 24 are generally horizontally oriented, the first and second surfaces 30, 34 are not actually horizontal when assembled into a wall but rather are askew from horizontal (and likewise askew from the horizontal upper and lower surfaces 32, 36 of anchoring unit 26 when assembled into a block 12). For example, the planes of the first 30 and second 34 surface may be between about 1 degree and about 90 degrees from horizontal. Alternatively, one or more planes on the upper 30 and/or lower surface may be horizontal, while the other planes may be askew from horizontal. Similarly, the planes of end surfaces 38, 39 are generally vertically oriented but are askew from vertical, such as between about 1 degree and about 90 degrees from vertical. Alternatively, one or more planes of the end surfaces 38, 39 may be vertical, while the remainder may be askew from vertical.

In some embodiments, each of the face units 24 has the same pattern on the front surface 20 while in other embodiments, the face units 24 of the wall 10 may have two, three, four or more different patterns on the front surface 20. In the embodiment shown, the front surfaces 20 have a first pattern 50 and a second pattern 52 and each face unit in the wall 10 is of the same shape. When aligned in a wall 10 as shown in FIG. 1, all of the face units 24 of the first course 14 are in a first orientation, with the first surfaces 30 on the bottom and their second surfaces 34 on top. In the second course 16, the blocks 12 are set in a staggered position relative to the first course 14 and are in a second orientation, which is inverted by 180° relative to the first orientation, with their second surfaces 34 on the bottom and abutting the second surfaces 34 of the blocks 12 of the first course 14. Further, because the units are staggered and laterally offset, each underlying block 12 mates along only a portion of its surface 30 or 36 with each overlying block. The non-horizontal, zig zagging first surfaces 30 of adjoining courses mate with each other in the offset position, providing stability as well as minimizing the visibility of the courses. In addition, the use of two patterns, each of which is inverted between one course and the next thereby resulting in 4 patterns, obscures the redundancy of the patterns, making the pattern appear random and therefore more natural.

It can further be seen that each of the planes of the first 30 and second 34 surfaces and the end surfaces 38, 39 of the face units 24 form edges having straight lines and generally sharp angles where the courses abut at the front surface 20. Similarly, the grooved patterns 50, 52 consist of multiple straight lines and generally sharp angles on the front surface 20. The straight line groove patterns 50, 52, together with the straight lines of abutment which also appear like the grooves in the patterns 50, 52, result in an illusion of a plurality of irregularly shaped straight edged pieces stacked into a wall, with the line of abutment blending with the groove pattern 52 and appearing like the edges of irregularly shaped flat faced stones, like flag stones.

When the face unit 24 and the anchoring unit 26 are interlocked, as shown in FIG. 3, the multi-component SRW 12 formed contains a hollow core 40. An additional hollow core 41 is formed by the connecting anchor 27 at the connection between side-by-side adjacent blocks 12. Hollow core 40 extends vertically through the SRW block from the lower bearing surface to the upper bearing surface and is bounded by inner walls of the anchoring unit 26 and the face unit 24. Similarly hollow core 41 extends vertically along adjoining SRW blocks 12. Hollow cores 40 and 41 provide several advantages. First, hollow cores 40 and 41 reduce the quantity of material required for production of the SRW block, which is a cost reduction feature. Hollow cores 40 and 41 also reduce the weight per square foot of the SRW block without sacrificing the load bearing strength. This feature lightens the load for shipping as well as for those persons who move, stack, or otherwise handle the individual blocks from production to ultimate placement and wall assembly. Hollow cores 40 and 41 may also be filled with a rock or earthen fill to stabilize and reinforce the wall 10 against the soil pressure. Such fill may include a clean granular backfill, such as clean crushed rock or binder rock, or on-site soils such as, for example, black earth, typically containing quantities of clay and salt. As noted below, the relative positions of the face unit connectors and the anchoring unit connectors form an interlock that is stabilized via the addition of fill in the hollow core 40. That is, the connectors permit relative vertical movement between the face unit 24 and the anchoring unit 26 but resist and generally prevent relative longitudinal (front to back) movement and lateral (side to side) movement between the face unit 24 and the anchoring unit 26. The fill adds pressure internal to SRW block 12 within the hollow core 40 to further restrict all relative movement between the face unit 24 and the anchoring unit 26.

In alternative embodiments, the anchoring unit may include the same number of connectors as the face unit. For example, both the face unit and the anchoring unit may have two connectors, or both may have three connectors. In embodiments in which face units and the anchoring units each have three connectors, each connector of the anchoring unit may be connected to each connector of only one face unit, rather than spanning to a second face unit. In such embodiments, two hollow cores 40 would be present in the SRW block 12. Alternatively, two connectors of the anchoring unit may connect to one face unit and one connector may connect with a side adjacent face unit. In some embodiments, the anchoring units 26 have a single connector, and are therefore T-shaped. The face units 24 may be arranged such that one, two, or more T-shaped anchoring units (single connector) may be connected to a single face unit 24.

In some embodiments, there can be a small gap in the interface between the connectors providing a loose connection between the face unit 24 and anchoring unit 26. The small gap 42 provides for easier assembly of the anchoring unit 26 and face unit 24 into a SRW block 12 and allows for limited relative movement (play) between the anchoring unit and the face unit without disconnecting the interlock. With the "play" as described above, the SRW block 12 conforms better to lower courses or the terrain.

The front surface 20 provides a facing surface that defines part of the exposed surface of the retaining wall. The back surface 28 is generally planar and has three connectors 48 for interconnection with the connectors of an anchoring unit. In the embodiment shown, the connectors 48 are formed as recesses or pockets in the back surface 28. The pockets are shaped as elongated keyways that run the entire height of the face unit, from the first surface 30 to the second surface 34. It is understood, however, that the keyway need not extend the entire height of the face unit 24. However, by extending the keyways the full height, the face units may be easily inverted in every other course as described above, such that the connectors of the anchoring units 26 may be easily slid into the inverted face units after stacking into a course. The keyways are shaped to permit relative vertical movement between the face unit 24 and the anchoring unit 26, but to generally restrict movement in other directions. The pockets could be of other shapes long as they remain of complementary size and shape to the anchoring unit connectors. The generally flat surface 49 of the pocket leaves more mass intact in the face unit and adds strength to the face unit 24. That is, the pocket extends inward less than half the depth of the face unit 24 due, in part, to the flat surface 49 formed by the pocket. Between the connectors 48 are two central portions 47 of the back surface. The central portions 47 can form a wall of hollow core 40 or 41 (see FIG. 2). The side walls 44, 46 of face unit 24 may be perpendicular to the front surface 20 as shown or may taper inwardly rearwardly.

In some embodiments, the face unit 24 includes an alignment element formed as pin recesses or apertures. In some embodiments, such apertures extend vertically through the entire height of face unit. The face unit 24 may be positioned such that one or more apertures of one face unit 24 may be aligned the corresponding one or more apertures of subjacent and superimposed face units 24. The elongated vertical passages created by such alignment may be filled with dirt or other materials or receive vertical tie elements such as re-bars. Accordingly, apertures may be used to align and tie stacked blocks to one another. In other embodiments, apertures do not extend through the entire height of the face unit. Instead, apertures extend part way from both the first surface 30 and the second surface 34 of the face unit 24. In such case, apertures may be used to align and tie stacked blocks to one another via the use of short pins.

Figure 7A:
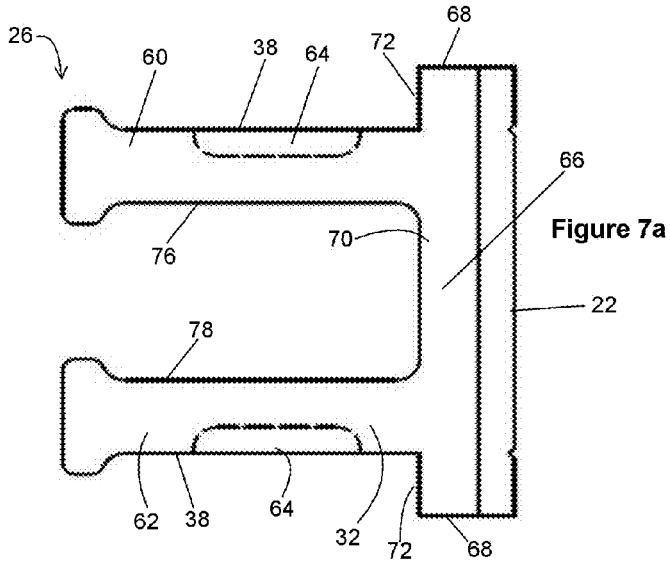
FIG. 7*a* is a top view of an anchoring unit according to embodiments of the invention.
Figure 7B:
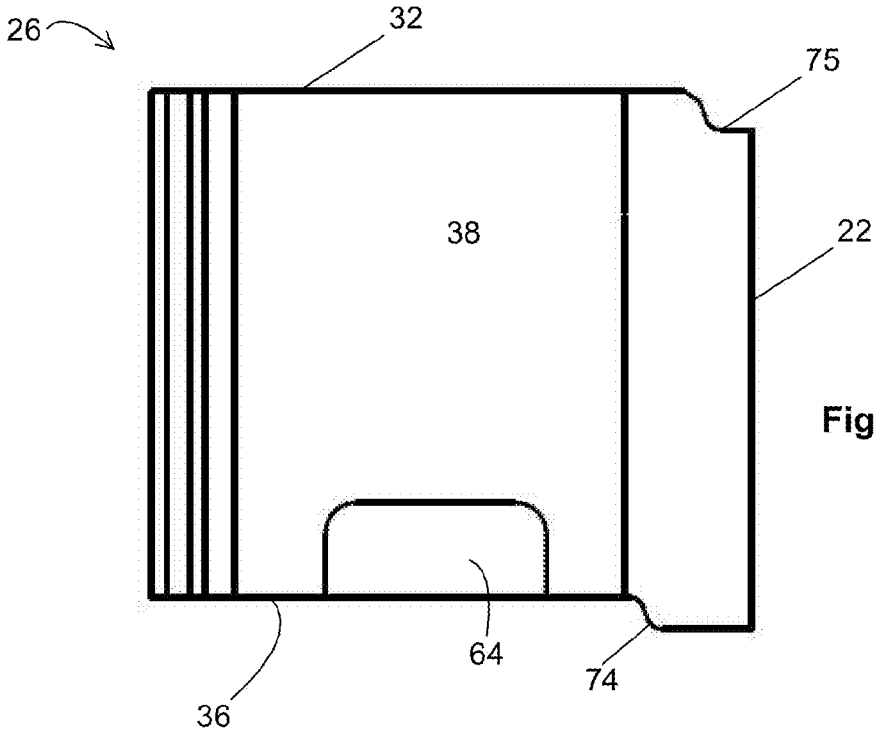
FIG. 7*b* is a side view of the anchoring unit of FIG. 7*a;*

FIGS. 7*a* and 7*b* are top and bottom views of anchoring units 26 that may be used in blocks 12 with any of the embodiments of face units described herein. Anchoring unit 26 is generally U-shaped having a first leg 60 and second leg 62 interconnected by a back segment 66. The back segment 66 has a rear surface 22 that forms the back surface of the SRW block and confronts soil being retained by the retaining wall. The first leg 60 and second leg 62 are inset from the side ends 68 of the back segment 66, and are therefore connected via a central portion 70 of the back segment 66. Accordingly, the back segment 66 also includes outer flanges 72 that extend outward of the central portion 70. The width of the back segment 66 may be equal to the widest portion of the face unit or may be slightly narrower than that of the widest portion of the face unit. In certain embodiments, the back segment 66 extends approximately the same width as the back face of the face unit. In alternate embodiments, the outer flanges 72 are eliminated and the back segment 66 only includes the central portion 70. In the embodiment shown, the first leg 60 and second leg 62 terminate in respective connector elements. The connector elements are shaped as hammer-head keys that extends the entire height of the anchoring unit 26. It is understood, however, that the keys need not extend the entire height of the anchoring unit 26. The connector elements are of complementary shapes to the face unit connector elements for interconnection therewith. The two connector elements are of the same shape and/or size. It is understood, though, that connector elements may be of different shapes and/or sizes as long as the connector elements of the face unit are constructed of complementary shapes and/or sizes for interconnection therewith. For instance, the connector shape could be circular instead of a flat hammer-head.

First leg 60 and second leg 62 of the anchoring unit 26 form outer side walls of the SRW block. In the embodiment shown, the side walls extend the entire height of the anchoring unit 26, from a lower load bearing surface 36 of the anchoring unit to an upper load bearing surface 32 of the anchoring unit. The load bearing surfaces 32, 36 are substantially planar, parallel to each other, and each formed transversely to the back segment 66. The upper surface 32 mates with and supports the lower surface 36 of a super-imposed stacked SRW block. As noted above, when a face unit and an anchoring unit are interlocked, as shown in FIG. 2, the multi-component SRW formed contains a hollow core 40. The hollow core 40 is formed, in part, by an inner surface 76 of the first leg, an inner surface 78 of the second leg 62, and the front wall of the back segment 66. In some anchoring unit embodiments, the first leg 60 and the second leg 62 include hand-holds 64 useful when lifting the anchoring units 26. In the embodiment shown, hand-holds 64 are formed as recesses on the bottom of the outside walls. The hand-holds 64 may also be formed as protrusions and they may be located at convenient locations other than the bottom of the outside walls (e.g., midway up or at the top of the outside walls).

Anchoring units 26 may also be manufactured with one or more alignment elements, including a lip, notch, pin recess, protrusion, and a slot. In some embodiments, anchoring unit 26 includes two alignment elements. One alignment element is formed as a lip 74 extending laterally across the width of the otherwise flat lower surface 36 of the anchoring unit 26 at the back of the back segment 66. The second alignment element is a notch 75 extending laterally across the width of the otherwise flat upper surface 32 of the anchoring unit 26 at the back of the upper surface 32. Accordingly, the setback depth of each course of blocks is based on the difference in depths between the laterally extending lip 74 and the notch 75 of anchoring unit 26, such that when the depths are the same, they may have no setback. Alternatively, the anchoring unit 26 may include one or more protrusions extending across less than the width of the otherwise flat lower surface 36, and one or more slots likewise extending across less than the width of the otherwise flat upper surface 32 of the anchoring unit 26. When oriented in a stacking relationship, the protrusions of the overlying unit 26 will fit into the slots of the underlying unit 26. If the anchoring units 26 are inverted when stacked, the protrusions of the underlying unit 26 will fit into the slots of the overlying unit 26. Anchoring units 26 may be manufactured without any alignment element.

Figure 8:
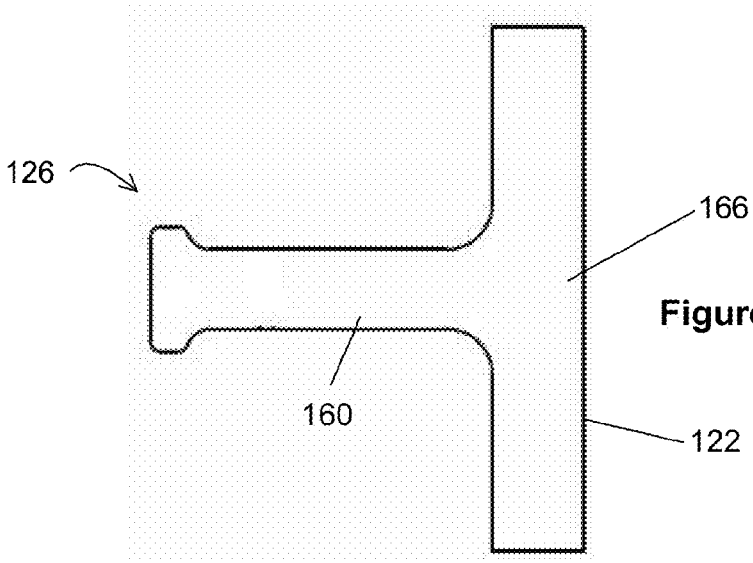
FIG. 8 is a top view of an anchoring unit according to alternative embodiments of the invention.

A top view of a T-shaped anchoring unit which may be used in embodiments of the invention is shown in FIG. 8. The anchoring unit 126 includes a single leg 160 terminating in a connector and connected to a back segment 166 having a rear surface 122. The back segment 166 is sufficiently wide to retain soil yet narrow enough to allow two anchoring units 126 to be used side by side in adjacent connectors of the same face unit 24 or in an abutting face unit 24.

According to some alternate embodiments of the present invention, the anchoring unit may be similar to those shown in FIGS. 7*a*, 7*b* and 8, except that it may be deeper. Since deeper anchoring units have greater mass and greater load bearing surfaces, they increase the stability of the resulting retaining wall. Deeper anchors may therefore be appropriate for taller retaining walls. That is, instead of, or in addition to other types of anchoring devices, such as geogrid, a deeper anchor may be used to help stabilize taller retaining walls. In order to strengthen the deeper anchor an additional cross-member, beyond the cross-member formed by the back segment, extending from first leg inner surface 76 to second leg inner surface 78, can be included in the manufacture of the deeper anchor, with such additional cross-members bifurcating the hollow cores.

In some embodiments, one end surface 38, 39 of face unit 24 may be finished to match the front surface 20. It may be approximately transverse to the front surface 20 of face unit 24 and may be in a single, vertically oriented plane, or may include more than one plane. Accordingly, face unit 524 may be used as part of the SRW block that forms the end block or last block in a course of blocks of a retaining wall.

The center to center distance of the connectors of anchoring units 26 and 27 may be equal to the center to center distance of the connectors of face units 24. By manufacturing the face units and anchoring units with such symmetry, one anchoring unit may connect between two adjacent face units.

Various alternative embodiments of the face units may be used in the retaining walls as described herein. Like the face units 24, the alternative face units may be non-planar or have multiple planes across their upper and/or lower surfaces and side surfaces to eliminate continuous horizontal and vertical lines in the walls and to more closely resemble natural stone walls. In addition, each of the alternative face units has a back surface with connectors and can be used with the anchoring units 26 and 27 and the variations thereof as described above.

Figure 9:
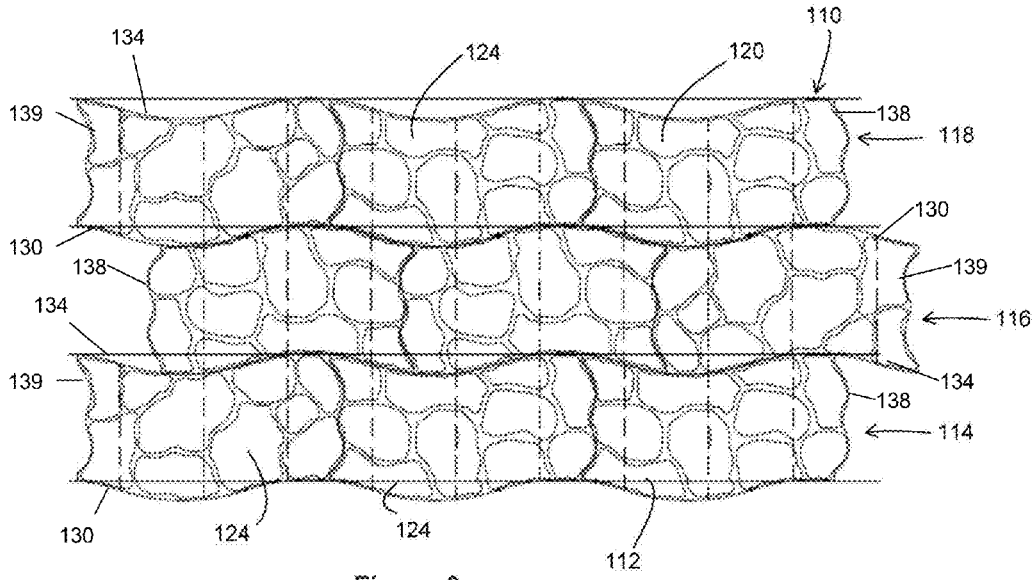
FIG. 9 is a front view of a retaining wall according to embodiments of the invention.
Figure 10:
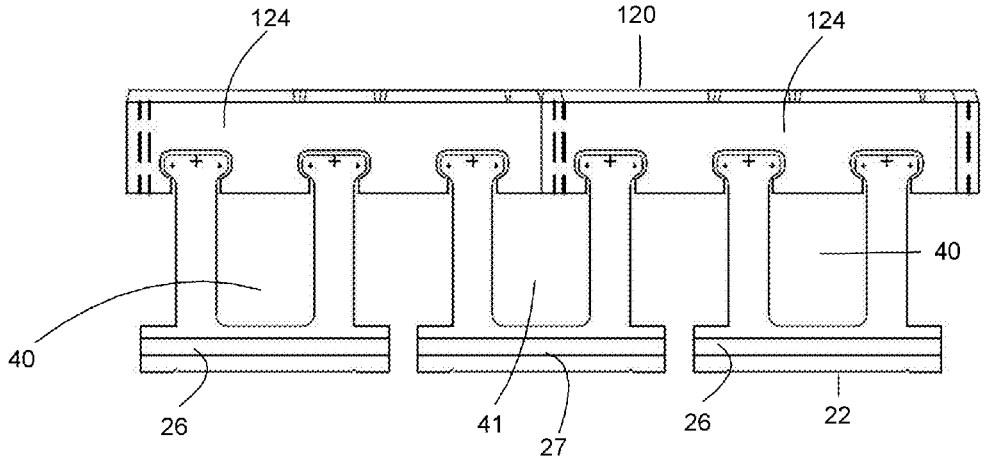
FIG. 10 is a top view of two if the segmental retaining wall units of FIG. 9.
Figure 11:
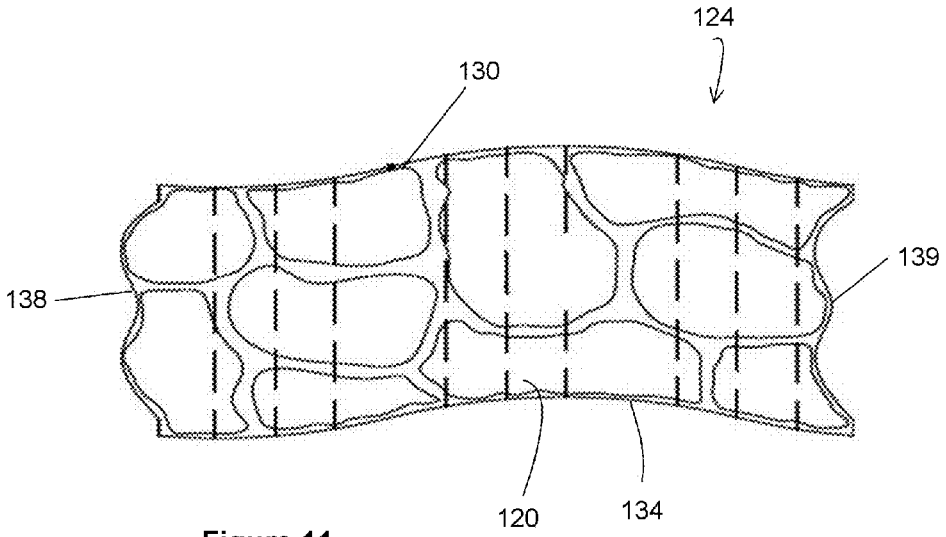
FIG. 11 is a front view of a face unit of FIG. 9.
Figure 12:
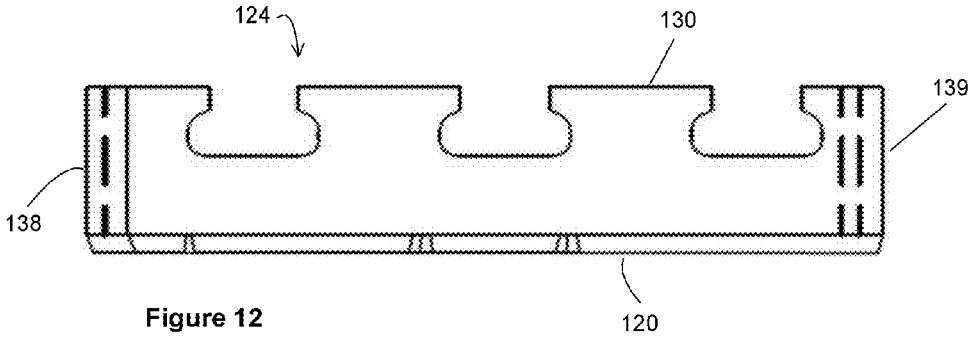
FIG. 12 is a top view of a face unit of FIG. 9.
Figure 13:
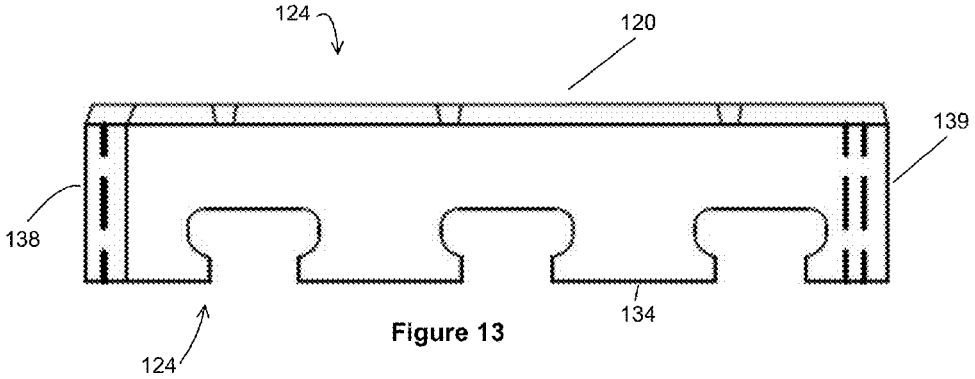
FIG. 13 is a bottom view of a face unit of FIG. 9.

One alternative face unit is shown assembled into a wall 110 in FIG. 9 and connected to anchoring units 26 and 27 in a top view in FIG. 10. FIG. 11 is a front view; and FIGS. 12 and 13 are top and bottom views respectively of the face unit 124 of FIG. 9. Each of the first surface 130, second surface 134, and end surfaces 138, 139 have no planar surfaces but rather form continuous curves from one end to the other end of the first surface 130 and second surface 134. Directly opposing portions of the first surface 130 are parallel to the second surface 134, as are the directly opposing portions of the first end surface 138 and the second end surface 139. In alternative embodiments, the first surface 130 may not be parallel to the second surface 134 and/or the end surfaces 138, 139 may not be parallel. The front surface 120 has one of two grooved patterns of multiple smooth-sided irregular stones. When stacked into a wall 110 as shown in FIG. 9, with overlying units offset, the curved surfaces of adjacent face units 124 fit smoothly together. In a first course 114, the face units 124 are used in a first orientation with the second surface 134 at the top. In a second course 116 directly atop the first course 114, the face units 124 are inverted and staggered relative to the first course 114 so that the second surfaces 134 of the face units 124 of each course matingly abut each other. In a third course 118, the face units 124 are in the first orientation again, such that the first surfaces 130 of the face units 124 of the second course 116 abut and support the first surfaces 130 of the face units 124 of the third course 118. As such, as in the wall 10 of FIG. 1, the face units 124 of wall 10 are inverted in every other course. As can be seen in FIG. 9, the abutting edges of the first and second surfaces 130, 134 and the end surfaces 38, 39 at the front faces 120 form a wavy line without sharp angles and with no horizontal or vertical lines at the abutments. These smooth, wavy lines of abutment merge with the smooth grooves of the rock pattern on the front surfaces 120 which likewise generally lacks sharp angles to obscure the abutment lines and create a more natural rock wall like appearance.

Figure 14:
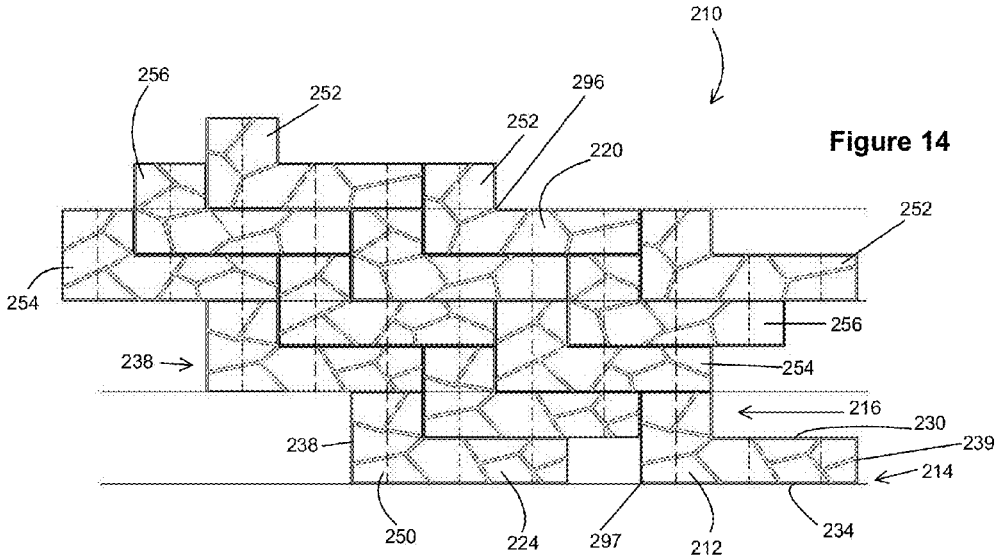
FIG. 14 is a front view of a retaining wall according to embodiments of the invention.
Figure 15:
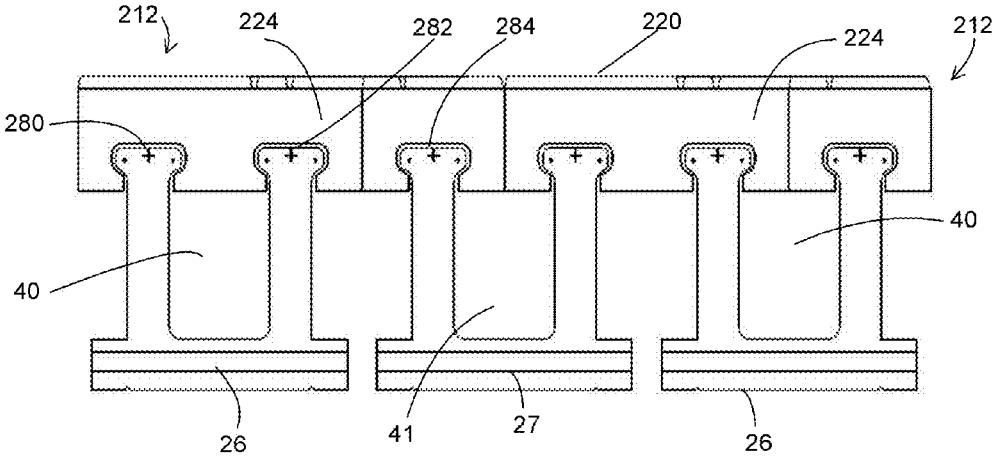
FIG. 15 is a top view of two if the segmental retaining wall units of FIG. 14.
Figure 16:
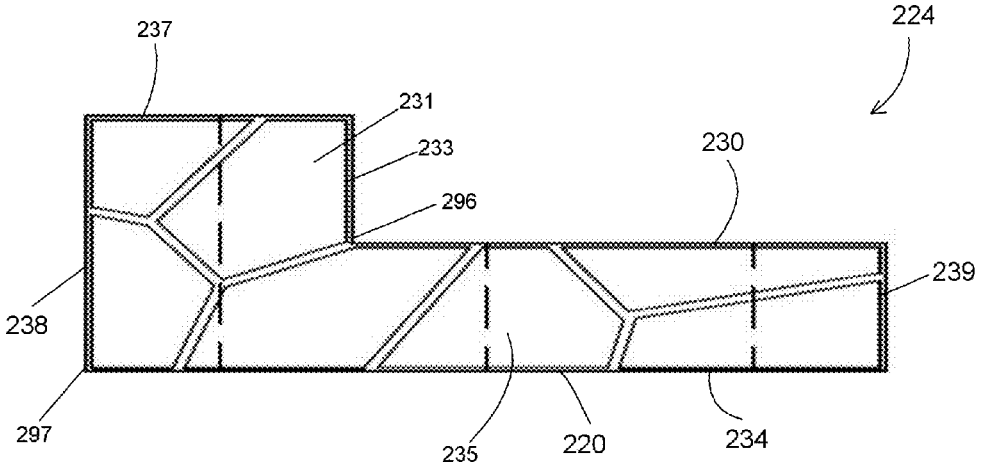
FIG. 16 is a front view of a face unit of FIG. 14.
Figure 17:
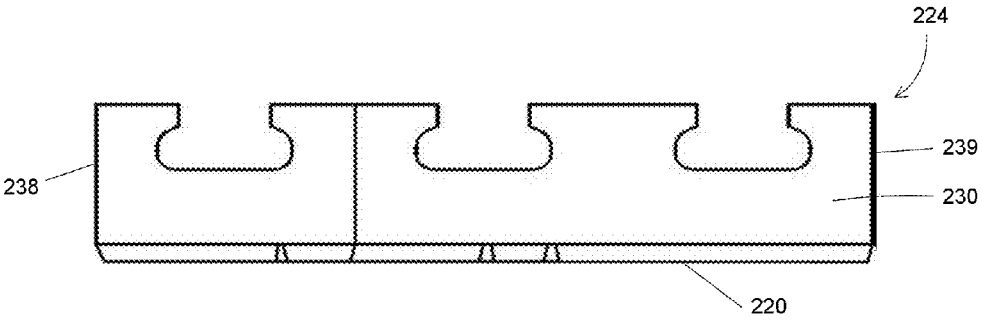
FIG. 17 is a top view of a face unit of FIG. 14.
Figure 18:
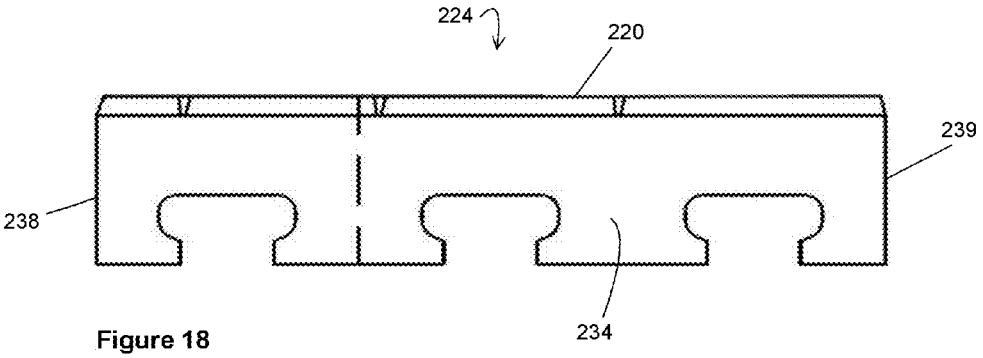
FIG. 18 is a bottom view of a face unit of FIG. 14.
Figure 19:
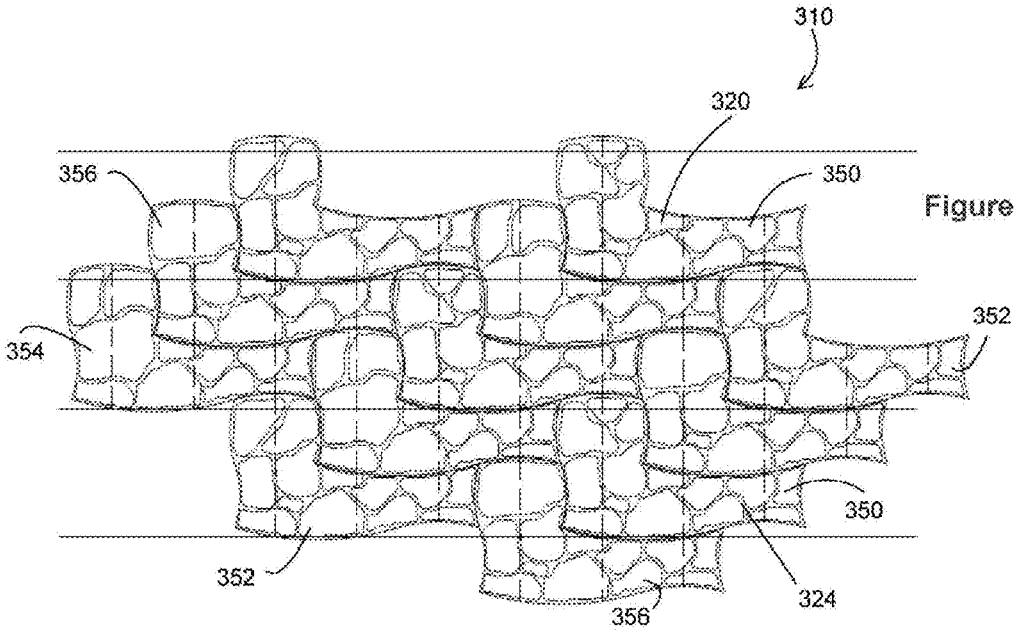
FIG. 19 is a front view of a retaining wall according to embodiments of the invention.
Figure 20:
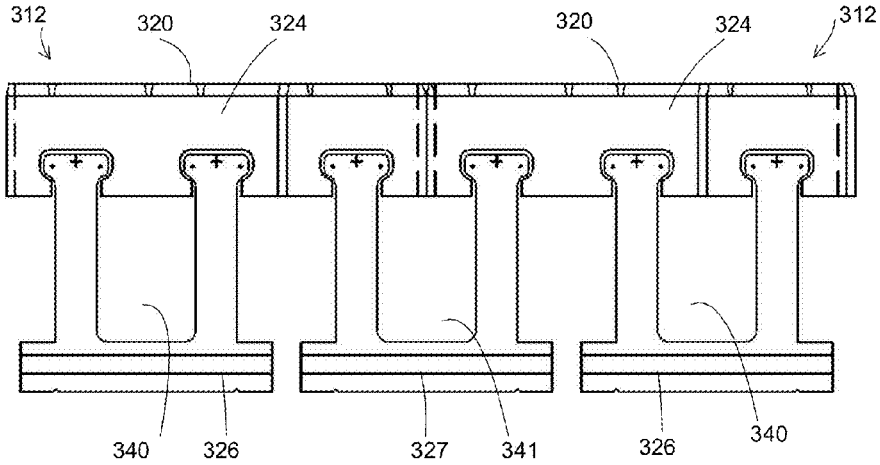
FIG. 20 is a top view of two if the segmental retaining wall units of FIG. 19.
Figure 21:
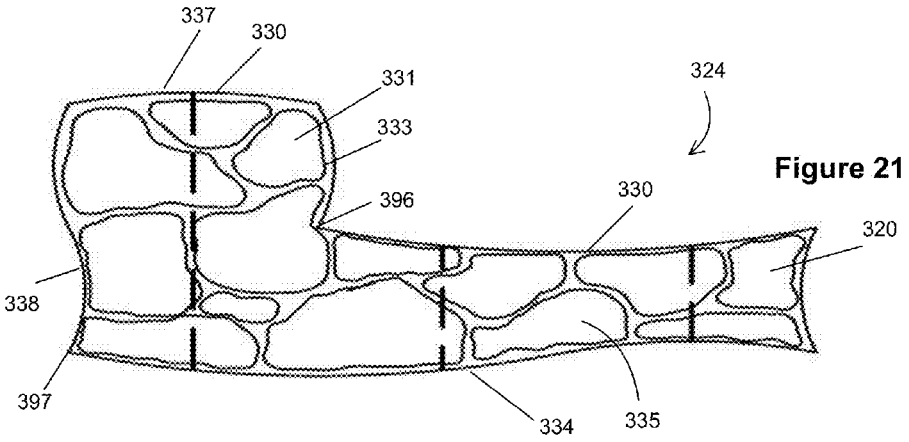
FIG. 21 is a front view of a face unit of FIG. 19.
Figure 22:
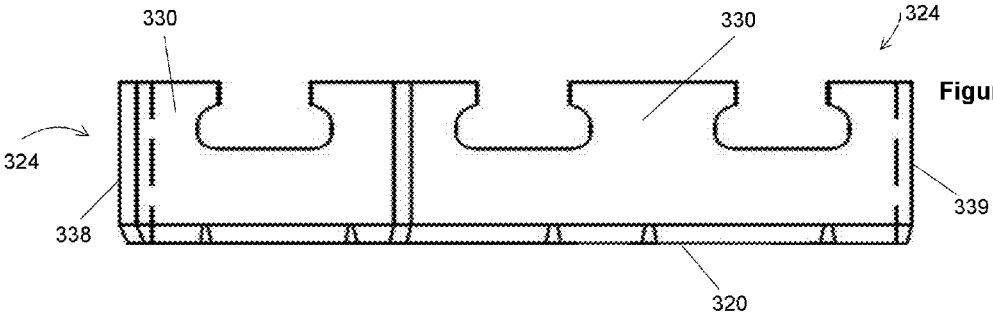
FIG. 22 is a top view of a face unit of FIG. 19.
Figure 23:
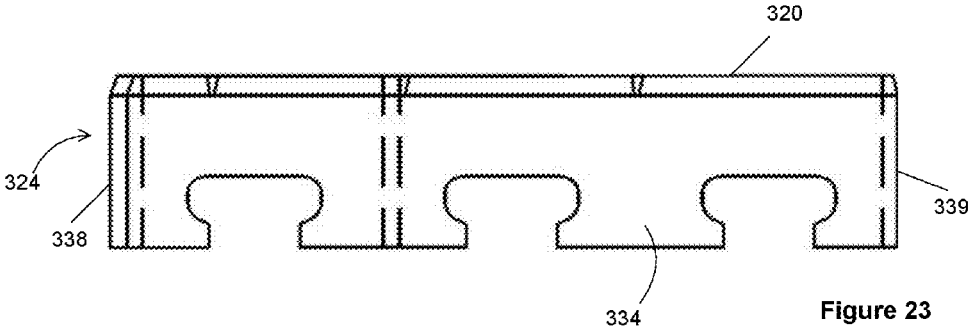
FIG. 23 is a bottom view of a face unit of FIG. 19.

Another alternative embodiment is shown in FIGS. 14-18. FIG. 14 is a front view of a wall 210, while FIG. 15 is a top view of a pair of blocks 212 as used in wall 210. FIG. 19 is a front view, and FIGS. 20 and 21 are top and bottom views respectively of a face unit 224 of FIG. 14. In this embodiment, the face units 224 are L-shaped and have a horizontally oriented planar lower (or second) surface 234 and vertically oriented planar end surfaces 238 and 239. The upper (or first) surface 230 does not have a single planar surface but rather includes a stepped up portion 231, extending upward approximately perpendicular to the main body 235 of the face unit 224. The upper surface 237 of the stepped up portion 231 extends along approximately one third of the length of the face unit 224 while upper surface 230 extends along approximately two thirds of the length of the face unit (as measured from end surface 238 to end surface 239). The height of the first end 238, measured from lower surface 234 to upper surface 237 is approximately two times the height of second end 239, measured from lower surface 234 to the upper surface 230. Both upper surfaces 237 and 230 are planar and are horizontally oriented. Face units 224 also include an inner corner 296 and an outer corner 297 at the bend of the "L." In the embodiment shown, the front surfaces 220 of the face units 224 includes a first pattern 250, a second pattern 252, a third pattern 254, and a fourth pattern 256, each having only straight lines/grooves and sharp angles, creating a look of multiple irregular stones having straight edges. The face units 224 can be stacked in a staggered manner as shown in FIG. 14, taking advantage of the L-shaped design of the face units 224. As can be seen, the face units 224 of the first course 214 are spaced apart by a gap having a distance equal to the length of upper surface 237. The lower surface 234 of the face units 224 of the second course rests upon the upper surface 230 of the face units 224 of the first course 214 and extends across the gap, with the outer corner 292 of the second course 216 abutting and nesting into the inner corner 290 of the first course 214. In each course except the first course 214, the face units 224 are spaced apart, with the gap between them occupied by the stepped up portion 231 from the face unit 224 in course directly below.

In this embodiment, the face units 224 are all used in the same orientation (none are inverted) but the presence of multiple staggered and discontinuous horizontal and vertical joinder lines at the front edges of each surface 230, 234, 238, 239 in the assembled wall, along with the use of multiple straight-lined patterns on the front surface 220, breaks up and obscures the appearance of courses of blocks, creating a look more like natural stone. Alternatively, the wall could be constructed with all of the face units rotated 180° (inverted) such that the upper and lower surfaces 230, 234 are reversed and the stepped up portion 231 projects downward.

It should further be noted that the back surface of stepped up portion 231 includes a connector 280 extending from upper surface 237 to lower surface 234 which is twice as long as the other two connectors 282, 284 of the face unit 224. As such, connectors 281 can accommodate two connectors of anchors 26, stacked atop each other. Because the connectors of overlying face units 224 are in direct alignment, two anchoring units 26 may be used in stacked relationship within the stepped up portion, with the upper anchoring unit 27 interconnecting with adjacent face units 224 as desired.

FIGS. 20-23 depict an alternative embodiment of an L-shaped face unit 324. The face unit is similar to the face unit 224 and includes the same elements which are similarly numbered, except that the upper surfaces 330 and 331, lower surface 334, and end surfaces 338 and 339 are curving and non planar across their entire lengths and do not form any horizontal or vertical joinder lines at their front edges when stacked into a wall 310. In addition, the four patterns 350, 352, 354 and 356 on the front faces 320 have only curved lines/grooves (no straight lines/grooves) to appear as a smooth sided, curved stone pattern. In all other respects, however, the discussion above with regard to face units 224 applies to face units 324.

In the first course 214, the gap may be filled by a small face unit designed for this purpose. Alternatively, the stepped up portion of the face unit 224 may be broken off from the body 235 and used to fill the gap in the first course 214.

A method of constructing a retaining wall using any of the SRW units disclosed herein will now be described. The face unit is placed into the desired location and orientation. The connectors of anchoring units 26 are then slid down the channels of the face unit connectors until the top surfaces and the bottom surfaces of the anchoring unit 26 and face unit 24 are approximately flush (though they cannot be exactly flush because of the non planar or multiplanar nature of the first and second surfaces 30 and 34 of the face units 24). In other embodiments, the anchoring unit 26 is placed into position first, followed by the face unit 24. Since there is a small gap 42 between the connectors, it is relatively easy to slide anchoring unit 26 into the face unit 24. In addition, the gap 42 permits one or both of the block components to be moved slightly after assembly in order to find a more stable position above the subjacent course of SRW blocks onto which the anchoring unit 26 and face unit 24 are placed. The gap may later be filled with a rock or earthen fill to reduce or eliminate the loose fit between the anchoring unit and face unit. Such fill may occur simultaneously with the filling of the hollow cores 40 and 41.

One or more features of the multi-component SRW blocks adds stabilization to the wall. For instance, as noted above, the anchoring unit and face unit each have upper and lower load bearing surfaces for mating with the lower load bearing surfaces of super-imposed stacked block. The load bearing surfaces of the anchoring units 26 are generally planar. The upper and lower load bearing surfaces of the face units are non planar or multiplanar and matingly align, fitting directly together like puzzle pieces. The surface area at the interface provides a sufficient coefficient of static friction to resist the shear forces applied by the soil that might otherwise cause block to slide forward along the upper load bearing surface of block. The load-bearing surfaces and mating alignment add stabilization to the wall. In addition, the anchoring units may include a lip and/or a notch. The confrontation of the lip on block with the notch on block can create a setback and further stabilize the wall or can be used without a setback. The same confrontation of the lip with the notch resists the shear forces applied by the soil that might otherwise cause block to slide forward along the upper load bearing surface of the block.

Face units and anchoring units may be manufactured using many different methods, including wetcast, drycast, or an extrusion. For instance, the face unit or the anchoring unit can be made through a process similar to that taught in Gravier, U.S. Pat. No. 5,484,236, the disclosure of which is incorporated herein by reference. An upwardly open mold box having walls defining one or more of the exterior surfaces of the block components is positioned on a conveyor belt. A removable top mold portion is configured to match other surfaces of the block component. A zero slump concrete slurry is poured into the mold and the top mold portion is inserted, with care being taken to distribute the slurry throughout the interior of the mold, following which the top mold portion is removed, as are the front, rear and side walls of the mold box, and the block components are allowed to fully cure. This reference to "top" may in fact be the bottom or other surface as the blocks are ultimately oriented. The same applies to references to bottom and side surfaces. In some embodiments in accordance with the invention, core bars of various sizes may be used to create anchoring units and face units. For instance, core bars may be used to create the alignment elements discussed herein, including lips, notches, pin recesses, and slots. Core pulling techniques such as disclosed in U.S. Pat. No. 5,484,236, entitled "METHOD OF FORMING CONCRETE RETAINING WALL BLOCK", assigned to the same assignee as the present invention, may be employed in production.

Since the block components are smaller than fully assembled blocks, multiple components may be formed at a time in a single mold box. For instance, it is known in the form blocks in pairs, whereupon a composite block is split to form a pair of substantially identical blocks to economize the production of the blocks. Further, splitting a composite block allows the formation of an irregular and aesthetically pleasant textured front surface for each of the blocks defined. Thus, splitting a molded composite block has the dual function of facilitating an economical method of producing multiple blocks from a single mold, and which blocks have an aesthetically pleasant exposed front surface. In embodiments of the present invention, it is possible that multiple composite blocks may be formed, where the composite blocks are split into face units with textured facing surfaces. Surfaces of the mold box or the surface of a divider plate inserted into the mold box may be embossed with different patterns so that the facing surfaces of the face units may be embossed with a pattern. Because face units are smaller than entire SRW blocks, and since they are similar to paver blocks, face units may also be manufactured using paving block machines and paving block manufacturing techniques. For instance, a separate face mix and base mix may be used to produce a face unit face up in a "Face and Base" paving block machine. In some embodiments, the face mix is a higher quality material, such as new concrete, and the base mix is a relatively lower quality material, such as recycled concrete. Since the base mix portion of the face unit will be hidden from view when constructed into a retaining wall, cost savings may be realized from such a manufacturing technique. In some embodiments, the 90% of the face unit is formed from the lower quality base mix while only 10% is the higher quality face mix. Producing face units in this manner eliminates height control issues found in typical retaining wall block manufacturing processes.

Independent of the manufacturing process used, the face units may be formed of different materials than those used for the anchoring units. For instance, since the anchoring units will be hidden from view when assembled into a retaining wall, the anchoring units may be formed of relatively lower quality materials than the face unit. That is, both may be formed of concrete, but the anchoring units may use a higher percentage of recycled materials. Alternatively, the face unit may be formed of concrete while the anchoring unit is formed of plastic.

In some embodiments, the anchoring units may be seen as generic or universal such that they may connect with many different types and styles of face units. Accordingly, one may retain fewer anchoring units in inventory as compared to the number of the universal face units retained. Some embodiments of the invention include a supply of preformed block components for forming a mortarless retaining wall comprised of segmental retaining wall (SRW) blocks. The preformed block components include face units having of differing styles or patterns and universal anchoring units that may be interlocked with any of the face units via complementary connector elements.

In the foregoing detailed description, the invention has been described with reference to specific embodiments. However, it may be appreciated that various modifications and changes can be made without departing from the scope of the invention as set forth in the appended claims.

The invention claimed is:

1. A mortarless retaining wall constructed of a plurality of segmental retaining wall ("SRW") blocks stacked in an array of superimposed rows, each SRW block comprising:

a face unit having a facing surface defining at least part of the exposed surface of the retaining wall, the face unit having connectors;

one or more anchoring units each having one or more connectors, the anchoring unit connectors being of complementary shape to interlock with respective face unit connectors, the face unit and each anchoring unit forming the SRW block when interlocked, each anchoring unit for confronting soil being retained by the retaining wall;

the face unit having first and second load bearing surfaces and first and second end surfaces, the first load bearing surfaces shaped to mate with the first or second load bearing surface of a super-imposed stacked SRW block and resisting shear forces between surrounding SRW blocks, the shear forces generated by soil retained by the retaining wall against the SRW blocks, the anchoring units each having upper and lower load bearing surfaces oriented in parallel and each being generally planar across the entire load bearing surfaces, the first and second load bearing surfaces of the face unit being not entirely planar across the load bearing surfaces, the first and second load bearing surfaces forming front edges each for mating with a super-imposed or subjacent face unit, and the first and second end surfaces forming front edges each for mating with a respective front edge of an adjacent face unit, each front edge being not entirely linear along the front edge.

2. The mortarless retaining of claim 1 wherein the first end surface of each face unit is shaped to mate with the second end surface of an adjacent face unit.

3. The mortarless retaining wall of claim 1 wherein the first load bearing surface is shaped to mate with the first load bearing surface of a super-imposed stacked SRW block.

4. The mortarless retaining wall of claim 1 wherein the second load bearing surface is shaped to mate with the second load bearing surface of a super-imposed stacked SRW block.

5. The mortarless retaining wall of claim 1 wherein each load bearing surface of the face unit is shaped to mate along only part of a load bearing surface of a super-imposed, inverted, stacked face unit when such face units are laterally offset from each other in a staggered configuration.

6. The mortarless retaining wall of claim 1 wherein the face units in a lower row of face units are shaped identically to an upper row of face units stacked thereon, the first load bearing surfaces on the lower row being shaped to mate along only part of the first load bearing surface on the upper row when the upper row face units are inverted and laterally offset from corresponding face units in the lower row in a staggered configuration.

7. The mortarless retaining wall of claim 1 wherein the upper load bearing surface of each anchor is shaped differently from the first load bearing surface of the face unit.

8. The mortarless retaining wall of claim 1 wherein the anchoring unit has at least one alignment element that aligns and resists the shear forces between a superimposed SRW block relative to its immediately subjacent block.

9. The mortarless retaining wall of claim 8 wherein the at least one alignment element includes a lip, notch, pin recess, protrusion, or slot.

10. The mortarless retaining wall of claim 8 wherein the at least one alignment element includes a lip of the anchoring units, the lip extending laterally under the anchoring units and at the rear thereof, the lip resisting shear forces applied by the soil retained by the retaining wall against the SRW block.

11. The mortarless retaining wall of claim 10 wherein the anchoring units include a notch extending laterally over the anchoring units and at the rear thereof.

12. The mortarless retaining wall of claim 11, the notch having a height which is generally less than or equal to a height of the lip.

13. The mortarless retaining wall of claim 11 wherein the laterally extending lip is defined with a depth approximately equal to a depth of the notch such that a vertically extending wall can be formed using such SRW blocks.

14. The mortarless retaining wall of claim 11 wherein the laterally extending lip is defined with a depth greater than the depth of the notch such that the retaining wall formed using such SRW blocks is formed with a setback, whereby the setback depth of each course of blocks is based on the difference in depths between the laterally extending lip and the notch.

15. The mortarless retaining wall of claim 8 wherein the at least one alignment element includes a lip of the anchoring units, the lip extending laterally over the anchoring units and at the rear thereof, the lip resisting shear forces applied by the soil retained by the retaining wall against the SRW block.

16. The mortarless retaining wall of claim 15 wherein the anchoring units include a notch extending laterally under the anchoring units and at the rear thereof.

17. The mortarless retaining wall of claim 1, the front surfaces having a pattern that includes grooves, all grooves being non-parallel to the upper and lower surfaces of the anchoring units.

18. The mortarless retaining wall of claim 1 wherein the first and second load bearing surfaces of the face unit are parallel.

19. A mortarless retaining wall constructed of a plurality of segmental retaining wall ("SRW") blocks stacked in an array of superimposed rows, each SRW block comprising:

a face unit having a facing surface defining at least part of the exposed surface of the retaining wall, the face unit having connectors;

one or more anchoring units each having one or more connectors, the anchoring unit connectors being of complementary shape to interlock with respective face unit connectors, the face unit and each anchoring unit forming the SRW block when interlocked, each anchoring unit for confronting soil retained by the retaining wall;

the face unit having first and second load bearing surfaces and first and second end surfaces, the first load bearing surfaces shaped to mate with the first or second load bearing surfaces of a super-imposed stacked SRW block and resisting shear forces between surrounding SRW blocks, the shear forces generated by the soil being retained by the retaining wall against the SRW blocks, the anchoring units having upper and lower load bearing surfaces oriented in parallel and each being generally planar across the entire load bearing surfaces, the first and second load bearing surfaces of the face unit being not entirely planar across the load bearing surfaces, the first and second load bearing surfaces forming front edges each for mating with a super-imposed or subjacent face unit and being not entirely horizontal along the front edge, and the first and second end surfaces forming front edges each for mating with a respective front edge of an adjacent face unit and being not entirely vertical along the front edge.

20. The mortarless retaining wall of claim 19, wherein each anchoring unit has at least one alignment element that aligns and resists the shear forces between a superimposed SRW block relative to its immediately subjacent block, the at least one alignment element including a lip, notch, pin recess, protrusion, or slot.

* * * * *